US009879955B2

(12) United States Patent
Rowley

(10) Patent No.: US 9,879,955 B2
(45) **Date of Patent: *Jan. 30, 2018**

(54) BROADHEAD ARROW

(71) Applicant: Victor Rowley, Versailles, MO (US)

(72) Inventor: Victor Rowley, Versailles, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/236,934

(22) Filed: Aug. 15, 2016

(65) Prior Publication Data

US 2016/0349024 A1 Dec. 1, 2016

Related U.S. Application Data

(63) Continuation-in-part of application No. 14/591,774, filed on Jan. 7, 2015, now Pat. No. 9,417,039.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 5,046,744 A * | 9/1991 | Eddy | F42B 6/08 473/583 |
| 5,178,398 A * | 1/1993 | Eddy | F42B 6/08 473/583 |
| 8,512,178 B2 * | 8/2013 | Peetz | F42B 6/08 473/583 |
| 9,417,039 B2 * | 8/2016 | Rowley | F42B 6/08 |

* cited by examiner

*Primary Examiner* — John Ricci
(74) *Attorney, Agent, or Firm* — Erickson Kernell IP, LLC

(57) ABSTRACT

An expandable broadhead includes an elongated ferrule and a blade. The ferrule includes a forward ferrule tip and an aft shank operable to connect the broadhead to an arrow shaft. The blade presents an elongated cutting edge that extends along the length of the blade. The blade is shiftably mounted relative to the ferrule to shift into and out of a retracted position where the blade extends alongside the ferrule. The blade extends forwardly beyond the ferrule tip in the retracted position so that the blade presents a forward facing edge of the broadhead.

20 Claims, 3 Drawing Sheets

BROADHEAD ARROW

CROSS-REFERENCE TO RELATED APPLICATIONS

This application is a continuation-in-part of, and claims priority to, U.S. patent application Ser. No. 14/591,774 filed on Jan. 7, 2015, which is hereby incorporated by reference herein in its entirety.

BACKGROUND

1. Field

The present invention relates generally to archery equipment. More specifically, embodiments of the present invention concern a broadhead for an arrow.

2. Discussion of Prior Art

It is well known for archers to use a bow and arrow for hunting various game. When hunting game, the archer often uses arrows having a broadhead. Broadheads are well known in the art and provide relatively large cutting edges. By having multiple large cutting edges, the broadhead inflicts maximum damage to the target animal and causes the animal to bleed rapidly. Conventional broadheads include fixed-blade designs where the blades are fixed to the ferrule of the broadhead. Other conventional broadheads include mechanical broadheads where the blades extend relative to the ferrule as the broadhead contacts the target.

However, prior art broadheads are known to have various deficiencies. For instance, while conventional broadheads have elongated cutting edges, such broadheads fail to cause enough damage to the animal such that the animal is killed swiftly and humanely. Prior art broadheads also cause the arrow to have limited range and poor accuracy.

SUMMARY

The following brief summary is provided to indicate the nature of the subject matter disclosed herein. While certain aspects of the present invention are described below, the summary is not intended to limit the scope of the present invention.

Embodiments of the present invention provide an expandable broadhead that does not suffer from the problems and limitations of the prior art broadheads set forth above.

A first aspect of the present invention concerns an expandable broadhead operable to be mounted on an arrow shaft. The expandable broadhead broadly includes an elongated ferrule and a blade. The ferrule includes a forward ferrule tip and an aft shank operable to connect the broadhead to the arrow shaft. The blade presents an elongated cutting edge that extends along the length of the blade. The blade is shiftably mounted relative to the ferrule to shift into and out of a retracted position where the blade extends alongside the ferrule.

In one exemplary embodiment, the blade extends forwardly towards the ferrule tip in the retracted position so that the blade presents a forward facing edge of the broadhead.

In another exemplary embodiment, the blade extends past the ferrule tip in the retracted position so that the blade presents a leading tip of the broadhead.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Exemplary embodiments of the invention are described in detail below with reference to the attached drawing figures, wherein.

Figure 10:
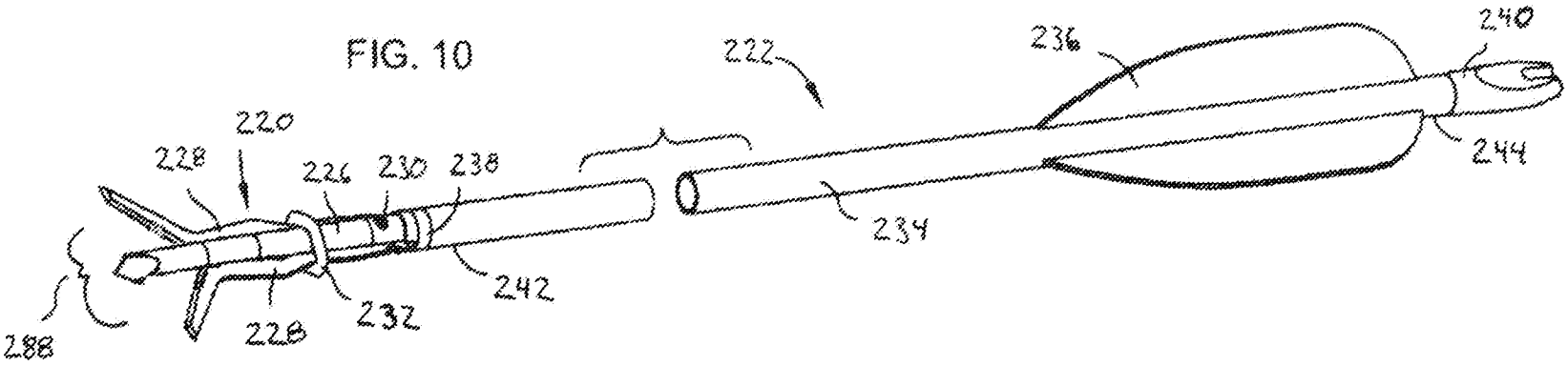
Figure 11:
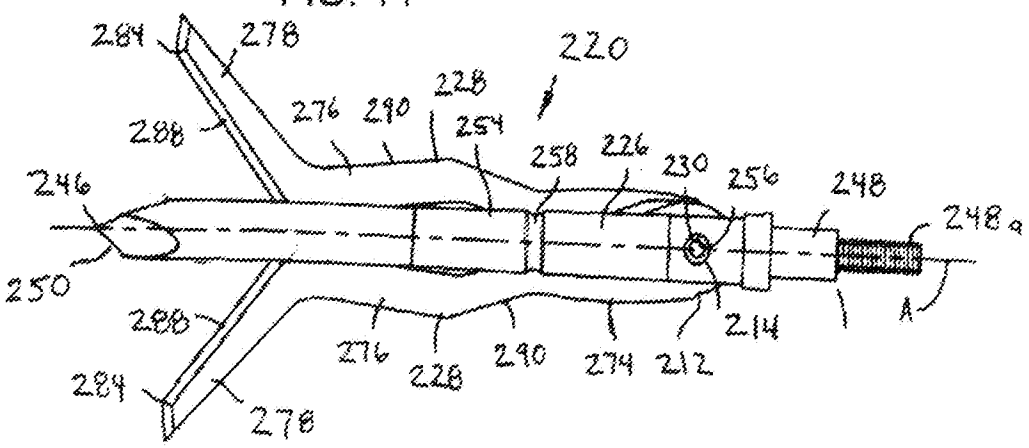

FIG. 10 is a fragmentary perspective of a broadhead arrow constructed in accordance with a second exemplary embodiment of the present invention, showing a broadhead, an elongated shaft, fletching, a threaded insert, and a nock of the arrow, with the broadhead including a ferrule, blades, a hinge pin, and a retention band; and FIG. 11 is a fragmentary top view of the broadhead shown in FIG. 10, showing the blades in a retracted position where the blades extend along the ferrule, with the retention band removed.

The drawing figures do not limit the present invention to the specific embodiments disclosed and described herein. The drawings are not necessarily to scale; emphasis instead being placed upon clearly illustrating the principles of the exemplary embodiments.

DETAILED DESCRIPTION OF EXEMPLARY EMBODIMENTS

Figures 1, 2, 3, 4, 5:
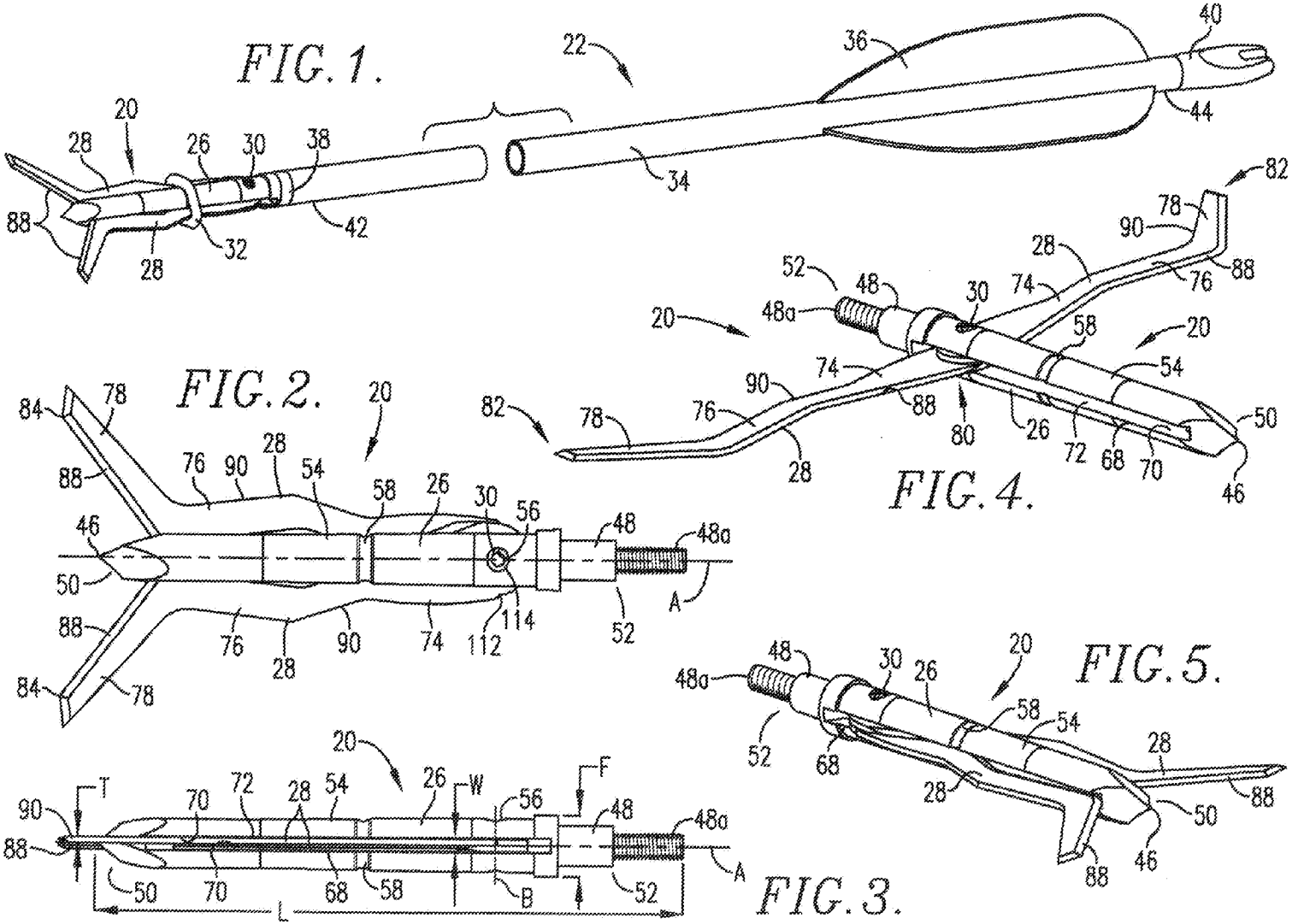
FIG. 1 is a fragmentary perspective of a broadhead arrow constructed in accordance with a first exemplary embodiment of the present invention, showing a broadhead, an elongated shaft, fletching, a threaded insert, and a nock of the arrow, with the broadhead including a ferrule, blades, a hinge pin, and a retention band.
FIG. 2 is a fragmentary top view of the broadhead shown in FIG. 1, showing the blades in a retracted position where the blades extend along the ferrule, with the retention band removed.
FIG. 3 is a fragmentary side elevation of the broadhead shown in FIGS. 1 and 2, showing a longitudinal slot presented by the ferrule and receiving the blades in the retracted position.
FIG. 4 is a fragmentary front perspective of the broadhead shown in FIGS. 1-3, showing the blades pivoted into a deployed position where the blades extend transversely to the longitudinal axis of the ferrule, with the blades projecting outboard of the ferrule.
FIG. 5 is a fragmentary front perspective of the broadhead similar to FIG. 4, but with the blades pivoted into the retracted position.

Turning initially to FIG. 1, an expandable broadhead 20 is constructed in accordance with a first exemplary embodiment of the present invention. The broadhead 20 is operable to be used as part of a broadhead arrow 22. In the usual manner, the broadhead arrow 22 is propelled by an archer using a bow (not shown). The broadhead arrow 22 is preferably used to hunt turkey, but can be used to hunt various other game, such as deer, elk, etc. The broadhead 20 preferably includes a ferrule 26, blades 28, hinge pin 30, and an endless retention band 32.

In addition to the broadhead 20, the broadhead arrow 22 also preferably includes an elongated shaft 34, fletching 36, threaded insert 38, and a nock 40. The shaft 34 is conventional and presents forward and aft shaft ends 42,44. Preferably, the shaft 34 is unitary and includes a carbon fiber tube that extends continuously between the shaft ends 42,44. However, it will be appreciated that the shaft 34 could include one or more of various other materials, such as wood, aluminum, synthetic resin, etc.

Turning to FIGS. 2-9, the ferrule 26 is preferably unitary and includes a forward ferrule tip 46 and an aft shank 48 that presents corresponding forward and aft ferrule ends 50,52. The aft shank 48 presents a threaded tip 48*a* that is removably threaded into the insert 38. The ferrule 26 extends continuously between the tip 46 and shank 48 to define a longitudinal ferrule axis A (see FIG. 2). The ferrule 26 preferably presents a maximum ferrule length L (see FIG. 3) that ranges from about forty millimeters (40 mm) to about one hundred fifty millimeters (150 mm) and, more preferably, is about eighty millimeters (80 mm). The ferrule 26 also presents a maximum ferrule diameter F that ranges from about four millimeters (4 mm) to about twenty millimeters (20 mm) and, more preferably, is about eight millimeters (8 mm).

The ferrule 26 presents an outer surface 54 that extends longitudinally between the tip 46 and shank 48 (see FIG. 5). The illustrated ferrule 26 presents a mounting hole 56 positioned between the tip 46 and shank 48 (see FIG. 2). The mounting hole 56 is substantially perpendicular to the longitudinal ferrule axis A and projects through the outer surface 54 (see FIG. 2). As will be discussed, the mounting hole 56 receives the hinge pin 30, which pivotally mounts the blades 28 to the ferrule 26.

Adjacent to the mounting hole 56, the outer surface 54 includes outer circumferential grooves 58. As will be explained, the grooves 58 removably receive the retention band 32.

Turning to FIGS. 6-9, the ferrule 26 preferably includes internal forward and aft blade stops 60,62 that are integrally formed as part of the ferrule 26. As will be discussed, the forward stop 60 is configured to engage forward portions of the blades 28. Similarly, the aft stop 62 is configured to engage aft portions of the blades 28 to restrict pivotal blade movement. The stops 60,62 present respective pairs of forward and aft stop surfaces 64,66. In the illustrated embodiment, the forward stop surfaces 64 taper inwardly to an edge 64*a* (see FIG. 7). Similarly, the aft stop surfaces 66 taper inwardly to an edge 66*a*.

However, it is within the ambit of the present invention where one or both of the blade stops 60,62 are alternatively configured to restrict blade movement. For instance, the forward stop surfaces 64 and/or the aft stop surfaces 66 could be spaced apart from one another. For some aspects of the present invention, the ferrule 26 could be devoid of the forward blade stop 60. For instance, the blades 28 could each have a shoulder to engage the aft blade stop 62 in the retracted position to restrict further pivoting movement of the blade 28 in a retracting direction.

The ferrule 26 also preferably defines a slot 68 that extends longitudinally between the tip 46 and the shank 48. In particular, the ferrule 26 presents opposed internal faces 70 that extend longitudinally and are substantially parallel to one another (see FIG. 3). Again, the stops 60,62 present respective stop surfaces 64,66. Thus, the faces 70 and the stop surfaces 64,66 cooperatively define the slot 68. However, it is within the ambit of the present invention where the slot 68 is alternatively defined (e.g., where the faces 70 and/or the stop surfaces 64,66 are alternatively shaped and/or positioned to define the slot 68).

The slot 68 preferably intersects the outer surface 54 to form opposite side openings 72 (sec FIGS. 3 and 4). The illustrated blade stops 60,62 arc preferably positioned laterally between the side openings 72 (see FIG. 7). In this manner, the ferrule 26 restricts foreign objects from interfering with engagement between the blades 28 and the blade stops 60,62.

The depicted slot 68 preferably extends completely through the ferrule 26 in a lateral direction. However, ferrule 26 could have alternative slotted openings to receive the blades 28. For instance, the ferrule 26 could present slots that are spaced apart from one another (i.e., the slots do not intersect one another) to receive corresponding blades 28.

The opposed faces 70 of the illustrated slot 68 cooperatively define a slot width dimension W (see FIG. 3). The slot width dimension W is sized so that the slot 68 slidably receives the blades 28, as will be discussed. In the illustrated embodiment, the slot width dimension W preferably ranges from about one half of a millimeter (0.5 mm) to about five millimeters (5 mm) and, more preferably, is about one and eight-tenths millimeters (1.8 mm). The depicted slot 68 is preferably coaxially aligned with the longitudinal ferrule axis A (see FIGS. 3 and 7).

Again, it will be appreciated that the slot 68 could be alternatively configured to accommodate the blades 28. For instance, the ferrule 26 could include more than two discrete slotted openings circumferentially positioned about the ferrule 26 (e.g., so that the ferrule 26 slidably receives more than two blades 28).

The illustrated ferrule 26 preferably includes an ANSI 7075A aluminum alloy material. However, it is within the ambit of the present invention where the ferrule 26 includes an alternative aluminum material. Furthermore, the ferrule 26 could include one or more alternative materials, such as stainless steel or a synthetic resin material.

Referring again to FIGS. 6-9, the blades 28 are each preferably unitary and are operable to be expanded from a retracted position to a deployed position when the broadhead 20 strikes a target (not shown). Because the blades 28 are preferably identical to one another, blade features described herein refer to each of the blades 28. However, it is within the scope of the present invention where the blades 28 have different configurations (e.g., where the blades have a different shape and/or different material).

Each blade 28 is preferably unitary and, other than the cutting edge, presents a substantially constant blade thickness dimension T (see FIG. 3). The blade thickness dimension T preferably ranges from about two tenths of a millimeter (0.2 mm) to about three millimeters (3 mm) and, more preferably, is about eight tenths of a millimeter (0.8 mm).

Figure 7:
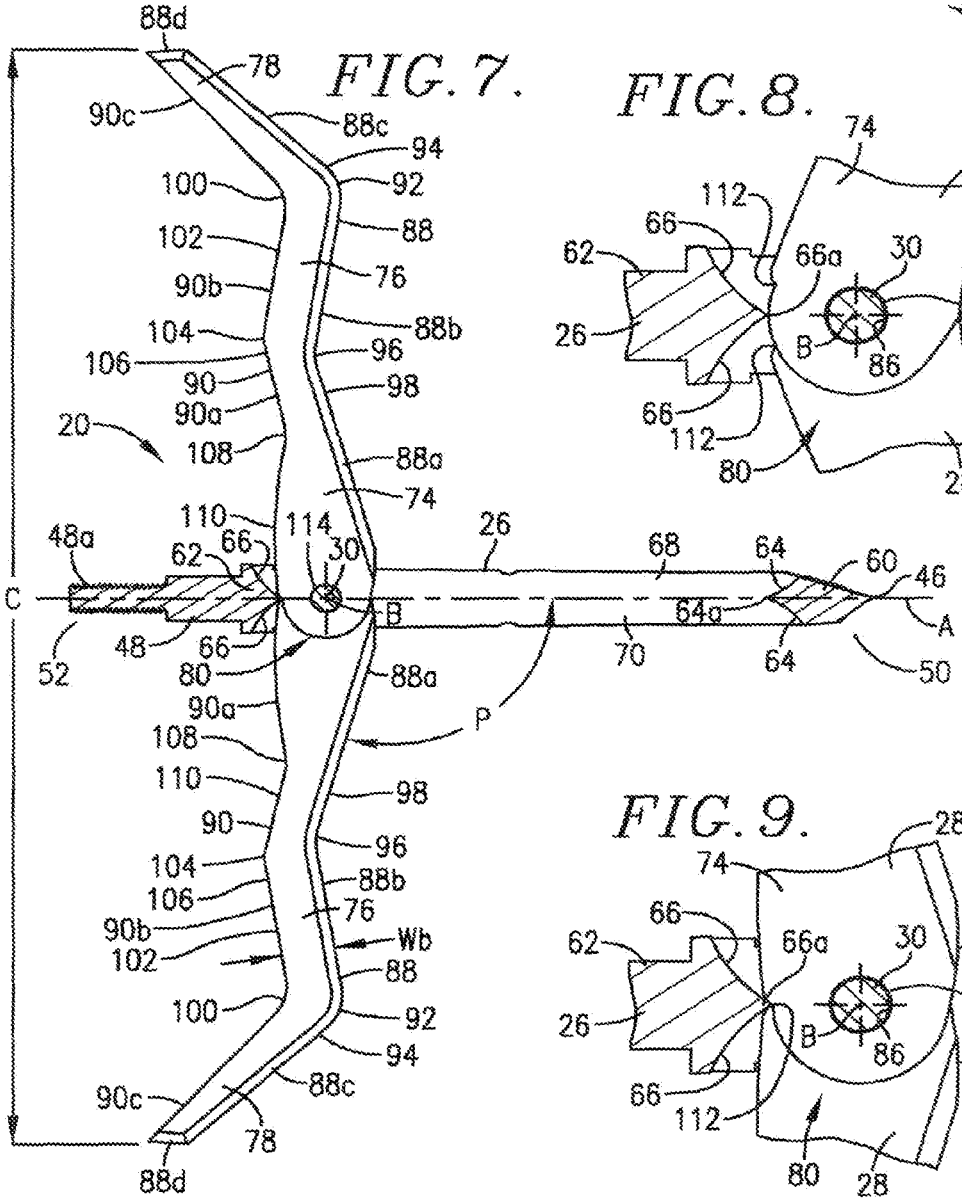
FIG. 7 is a cross section of the broadhead similar to FIG. 6, but showing the blades pivoted into the deployed position where the blades engage an aft blade stop of the ferrule.

Each blade 28 preferably includes a proximal blade section 74, an intermediate blade section 76, and a distal blade section 78 (see FIG. 7). The proximal and distal blade sections 74,78 present, respectively, a proximal attachment end 80 and a distal end 82. As will be discussed, the distal blade section 78 presents a leading tip 84 of the broadhead 20 when the blade 28 is retracted (see FIG. 2). The proximal blade section 74 preferably includes a hole 86 that extends through the proximal attachment end 80 (see FIG. 8). In other exemplary embodiments, the distal blade section 78 presents a forward facing edge of the broadhead 20 when the blade 28 is retracted.

The blade sections 74,76,78 cooperatively present a cutting edge 88 and an opposite blunt edge 90 that both extend along the length of the blade 28. The cutting edge 88 is preferably configured to slice through various animal tissues, including skin, muscle, cartilage, tendons, ligaments, etc. It will be appreciated that the cutting edge 88 may be capable of slicing and/or at least partly cutting into bone and/or other hard animal tissues. Furthermore, the cutting edge 88 is also preferably configured to slice through various plant tissues and synthetic materials.

The cutting edge 88 comprises a continuous, sharp blade edge and includes proximal, intermediate, and distal edge sections 88 *a,b,c* that extend along corresponding blade sections 74,76,78 (see FIG. 7). The cutting edge 88 also preferably includes an endmost edge section 88*d* at the distal end 82. The endmost edge section 88*d* extends at an angle relative to the distal edge section 88*c*. In the illustrated embodiment, the distal edge section 88*c* and the intermediate edge section 88*b* of the cutting edge 88 are angled relative to each other and meet at a convex portion 92 of the cutting edge 88 to cooperatively form a distal scalloped region 94 of the blade 28 (see FIG. 7). The intermediate edge section 88*b* and the proximal edge section 88*a* of the cutting edge 88 are also angled relative to each other and meet at a concave portion 96 of the cutting edge 88 to cooperatively form a proximal scalloped region 98 of the blade 28.

While the illustrated cutting edge 88 preferably includes the above-referenced features, it is within the scope of the present invention for the cutting edge 88 to have an alternative shape and/or configuration. For instance, one or both of the scalloped regions 94,98 could have an alternative shape. Furthermore, the scalloped regions 94,98 could be alternatively positioned relative to one another.

The opposite blunt edge 90 is preferably not suitable for cutting animal tissues, such as skin, muscle, cartilage, tendons, ligaments, etc. However, for some aspects of the present invention, at least part of the blunt edge 90 could include a sharp cutting edge. The blunt edge 90 preferably includes proximal, intermediate, and distal edge sections 90 *a,b,c* that extend along corresponding blade sections 74,76, 78 (see FIG. 7). The distal edge section 90*c* and the intermediate edge section 90*b* of the blunt edge 90 are angled relative to each other and meet at a concave portion 100 of the blunt edge 90 to cooperatively form a distal scalloped region 102 of the blade 28 (see FIG. 7). The intermediate edge section 90*b* and the proximal edge section 90*a* of the blunt edge 90 are angled relative to each other and meet at a point 104 to cooperatively form an intermediate scalloped region 106 of the blade 28 (see FIG. 7). Also, the proximal edge section 90*a* of the blunt edge 90 also presents another concave portion 108 of the blunt edge 90 to form a proximal scalloped region 110 of the blade 28 (see FIG. 7).

While the illustrated blunt edge 90 preferably includes the above-referenced features, it is within the scope of the present invention for the blunt edge 90 to have an alternative shape and/or configuration. For instance, one or more of the scalloped regions 102,106, 110 could have an alternative shape. Furthermore, the scalloped regions 102, 106,110 could be alternatively positioned relative to one another.

Also in the illustrated embodiment, the distal scalloped regions 94, 102 and the scalloped regions 98,106, 110 are preferably aligned along the length of the blade 28 so that the regions cooperatively define a blade width dimension Wb (sec FIG. 7) measured transverse to the longitudinal axis of the blade 28. Preferably, the blade width dimension Wb is generally constant between the concave portion 108 and the concave portion 100. Furthermore, the blade width dimension Wb preferably increases from the concave portion 108 toward the proximal attachment end 80 of the blade 28.

Figure 8:
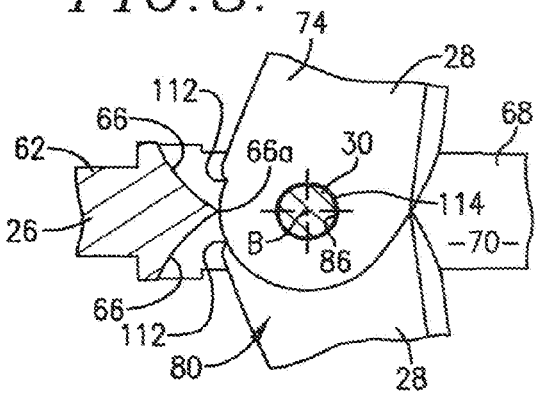
FIG. 8 is an enlarged fragmentary cross section of the broadhead shown in FIGS. 1-7, showing the blades pivoted to a position between the retracted and deployed positions, with each blade presenting a shoulder to engage the aft blade stop.

The blunt edge 90 also preferably presents a shoulder 112 adjacent the proximal attachment end 80 (see FIG. 8). As will be discussed, the shoulder 112 provides a surface that can be brought into engagement with the blade stop 62 to restrict pivotal blade movement.

The blades 28 each preferably include an ASTM Grade 301 stainless steel material. However, it is within the ambit of the present invention where the blades 28 include an alternative stainless steel material. Furthermore, the blades 28 could include one or more alternative materials, such as aluminum, carbon steel, and/or a synthetic resin material.

The illustrated broadhead 20 preferably includes a pair of blades 28. However, it is within the ambit of the present invention where the broadhead 20 includes more than two blades 28 positioned circumferentially about the ferrule 26. For some aspects of the present invention, the broadhead 20 could include a single blade 28.

The blades 28 are preferably attached to the ferrule 26 with the hinge pin 30. The hinge pin 30 preferably comprises a threaded set screw. However, other suitable fasteners could be used to removably mount the blades 28 to the ferrule 26.

The hinge pin 30 secures the blades 28 to the ferrule 26 at a pivot joint 114 so that the blades 28 can be swung into and out of the retracted position. Similarly, the pivot joint 114 permits the blades 18 to be swung into and out of the deployed position. As will be discussed further, the blades 28 are pivotal in a retracting direction to retract the blades 28 and in an opposite extending direction to deploy the blades 28.

In the illustrated embodiment, each blade 28 is mounted to the ferrule 26 by positioning the proximal attachment end 80 within the slot 68 so that the holes 56,86 are aligned with one another. With the holes 56,86 aligned, the hinge pin 30 is inserted through the ferrule 26 and the blades 28 and is threaded into secure engagement with the ferrule 26. As a result, the attachment end 80 is pivotally mounted in the slot 68. The pivot joint 114 defines a blade pivot axis B that intersects and is perpendicular to the slot 68 (see FIGS. 3 and 8). The blades 28 are also positioned so that the cutting edges 88 face one another when the blades 28 are retracted (see FIG. 2).

Again, each blade 28 is pivotally mounted to the ferrule 26 to pivot into and out of the retracted position. When mounted to the ferrule 26, each blade 28 extends alongside the ferrule 26 in the retracted position (see FIGS. 2, 3, 5, and 6). Furthermore, each blade 28 preferably engages the forward blade stop 60 in the retracted position (see FIGS. 5 and 6). In this manner, the forward blade stop preferably engages the blade 28 in the retracted position to restrict pivotal movement of the blade 28 in the retracting direction beyond the retracted position.

However, as discussed above, the forward blade stop 60 could be alternatively configured to engage the blade 28 in the retracted position. For instance, the forward blade stop 60 could be alternatively shaped and/or position. In another alternative configuration, the ferrule 26 could include a detent device (e. g., a spring-loaded detent mechanism) that provides the blade stop 60 and removably engages a complemental detent surface (not shown) on the blade 28. The detent device could be provided such that the retention band 32 is not needed to removably hold the blades 28 in the retracted position.

Yet further, the ferrule 26 could be devoid of the forward blade stop 60 (e.g., where another part of the ferrule 26 restricts further retraction of the blade in the retracted position). For example, the blades 28 could each have a shoulder to engage the aft blade stop 62 in the retracted position to restrict further pivoting movement of the blade 28 in the retracting direction.

In the retracted position, the illustrated blades 28 are preferably partly received within the slot 68. In particular, the blades 28 are positioned so that the cutting edges 88 along the proximal and intermediate blade sections 74,76 are located within the slot 68 and are thereby covered. It has been found that this retracted configuration restricts the covered portions of the cutting edges 88 from being inadvertently snagged and/or damaged by a foreign object prior to deployment of the blades 28.

Again, in the retracted position, the distal end 82 provides one of the leading tips 84 of the broadhead 20. More specifically, the distal blade sections 78 of the illustrated blades 28 extend forwardly beyond the ferrule tip 46 so that each blade 28 presents one of the leading tips 84 of the broadhead 20. In other words, the distal blade sections 78 preferably present the leading tips 84.

Preferably, in the retracted position, the leading tip 84 is spaced radially outboard of the ferrule 26. Also in the retracted position, the cutting edge 88 of the distal blade section 78 preferably extends rearwardly from the leading tip 84 at an oblique angle relative to the longitudinal ferrule axis A (see FIGS. 2 and 6). Preferably, the cutting edge 88 is located entirely forwardly of the pivot joint 114 in the retracted position, although the broadhead 20 could be alternatively configured, as will be discussed with respect to an alternative exemplary embodiment of FIGS. 10 and 11, described hereinbelow.

Figure 6:
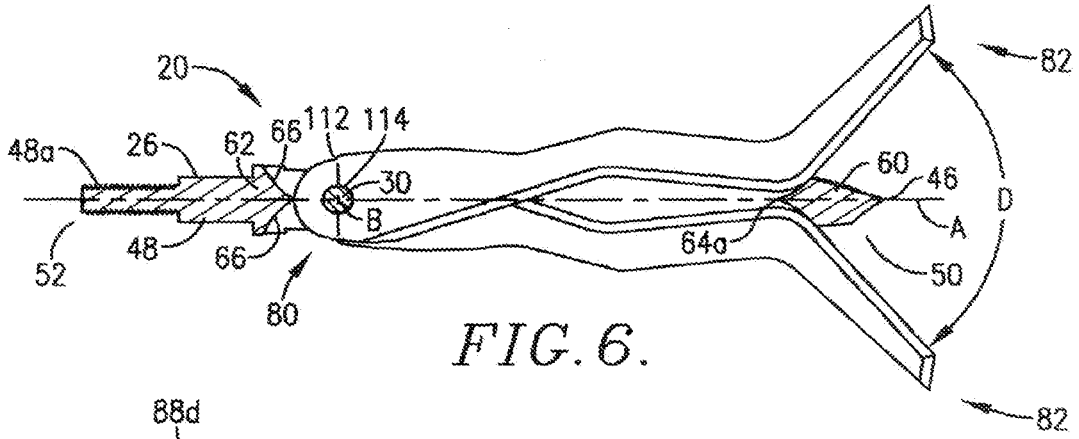
FIG. 6 is a cross section of the broadhead shown in FIGS. 1-5, showing the blades received in the slot in the retracted position, with the blades engaging a forward blade stop of the ferrule.

Furthermore, the distal edge sections 88*c* of the blades 28 cooperatively form an included angle D (see FIG. 6). The included angle D preferably ranges from about sixty degrees (60°) to about one hundred twenty degrees (120°) and, more preferably, is about ninety degrees (90°). However, the distal edge sections 88*c* could be alternatively oriented without departing from the scope of the present invention.

When in the retracted position, the proximal scalloped regions 98,110 are preferably longitudinally aligned with the grooves 58 (see FIG. 2). Thus, the proximal scalloped regions 98, 110 and the grooves 58 are configured to cooperatively receive the retention band 32 in the retracted position (see FIG. 1).

Preferably, the retention band 32 is operable to hold the blades 28 in the retracted position. The retention band 32 is preferably endless and includes an elastomeric material. Thus, the retention band 32 can be selectively elastically expanded by a user from a relaxed condition (not shown) where the band 32 is not held under tension. However, it is within the ambit of the present invention where an alternative structure is used to removably hold the blades 28 in the retracted position.

To prepare the broadhead 20 to be propelled as part of the arrow 22, the blades 28 are initially swung into the retracted position. With the blades 28 retracted, the retention band 32 can be expanded and passed over the leading tips 84 of the blades 28 and moved into alignment with the proximal scalloped regions 98, 110 and the grooves 58. Once in alignment (or near alignment) with the proximal scalloped regions 98,110 and grooves 58, the band 32 can be released so as to collapse into grasping engagement with the ferrule 26 and blades 28.

Again, the band 32 is preferably brought into engagement with the proximal scalloped regions 98,110 and grooves 58 (see FIG. 1). In this position, the band 32 is preferably elastically expanded from the relaxed condition so that the band 32 is under tension and applies a grasping force to the ferrule 26 and the blades 28. It will also be appreciated that the band can be passed onto the broadhead 20 from the opposite end thereof (e.g., when the broadhead 20 is detached from the shaft 34).

As the broadhead 20 strikes and moves forwardly into the target (not shown), the target applies a generally rearward force to the leading tips 84. The force of striking the target urges the blades 28 to pivot in the extending direction (i.e., toward the deployed position). More specifically, the force of striking the target causes the blades 28 to pivot so that the blades 28 rapidly elongate and break the retention band 32.

As mentioned above, each blade 28 is pivotally mounted to the ferrule 26 to pivot into and out of the deployed position. More specifically, the blade 28 is pivotal in an extending direction from the retracted position to a deployed position. When mounted to the ferrule 26, each blade 28 projects transversely relative to the longitudinal ferrule axis A in the deployed position (see FIGS. 4, 7, and 9). That is, the blades 28 project in an outboard direction relative to the ferrule 26.

Preferably, in the deployed position, the proximal edge section 88*a* of the cutting edge 88 and the longitudinal ferrule axis A cooperatively define a deployed blade angle P (see FIG. 7). The blade angle P preferably ranges from about seventy-five degrees (75°) to about one hundred thirty-five degrees (135°) and, more preferably, is about one hundred five degrees (105°). However, the proximal edge section 88*a* could be alternatively oriented without departing from the scope of the present invention.

The amount of angular blade movement from the retracted position to the deployed position preferably ranges from about sixth degrees (60°) to about one hundred twenty degrees (120°) and, more preferably, is about ninety degrees (90°). However, it is within the ambit of the present invention where the angular separation between the retracted and deployed positions is outside of the preferred range.

Figure 9:
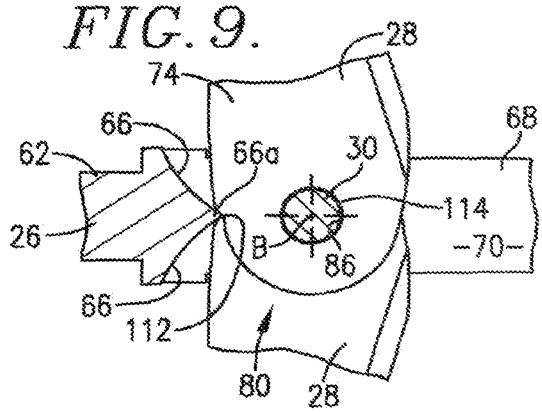
FIG. 9 is an enlarged fragmentary cross section of the broadhead similar to FIG. 8, but showing the blades pivoted into the deployed position where the shoulders engage the aft blade stop.

Furthermore, each blade 28 preferably engages the aft blade stop 62 in the deployed position (sec FIGS. 7 and 9). More particularly, the shoulder 112 presented by the blade 28 slides into and out of the slot 68 as the blade 28 swings between the positions. In the deployed position, the shoulder 112 is located within the slot 68 to engage the aft blade stop 62 (see FIGS. 7 and 9). In this manner, the aft blade stop 62 preferably engages the blade 28 in the deployed position to restrict pivotal movement of the blade 28 in the extending direction beyond the deployed position.

However, the aft blade stop 62 could be alternatively configured to engage the blade 28 in the deployed position. For instance, the blade stop 62 could be alternatively shaped and/or positioned to engage the blade 28 in the deployed position. Also, another part of the ferrule 26 could be configured to restrict further deployment of the blade 28 beyond the deployed position.

It is also within the ambit of the present invention where the ferrule 26 includes a mechanism to removably restrict blade movement out of the deployed position. For instance, the ferrule 26 could include a detent device (e.g., a spring-loaded detent mechanism) that removably engages a complemental detent surface (not shown) on the blade 28. For example, such a detent device could be provided as part of the aft blade stop 62.

The illustrated aft blade stop 62 is preferably fixed relative to the rest of the ferrule 26. However, the blade stop 62 could include an adjustment mechanism (not shown) such that the location of the deployed position of the blades 28 is adjustable.

In the deployed position, the proximal attachment ends 80 are positioned within the slot 68. Also, because each blade 28 projects transversely relative to the longitudinal ferrule axis A, the blades 28 are preferably located entirely rearward of the ferrule tip 46. Thus, in the deployed position, the distal ends 82 of the blades 28 define opposite outboard margins of the broadhead 20 that form a maximum cutting width dimension C (see FIG. 7). The maximum cutting width dimension C preferably ranges from about fifty millimeters (50 mm) to about two hundred millimeters (200 mm) and, more preferably, is about one hundred twenty millimeters (120 mm). However, it is within the ambit of the present invention where the maximum cutting width dimension C is outside of the preferred range.

When in the deployed position, the distal edge sections 88*c* preferably extend rearwardly and in an outboard direction from the convex portion 92. It has been determined that this rearward swept configuration of the distal edge sections 88*c* permits the broadhead 20 to slice more efficiently through tissue after the blades 28 are deployed.

Again, the broadhead 20 is preferably configured so that the blades 28 can smoothly swing between the retracted and deployed positions. However, the broadhead 20 could be configured so that the blades 28 can be removably set in an intermediate position between the retracted and deployed positions. For instance, the broadhead 20 could include a detent mechanism that removably locates the blades 28 in an intermediate position.

While the blades 28 preferably pivot between the retracted and deployed positions, the blades 28 could be alternatively shiftably attached to the ferrule without departing from the scope of the present invention.

In operation, the broadhead 20 is removably secured to the arrow shaft 34 by threading the shank 48 into threaded engagement with the insert 38. The blades 28 are held in the retracted position by installing the retention band 32 in engagement with the proximal scalloped regions 98,110 and grooves 58. With the blades 28 secured, the archer can propel the arrow 22 using a bow (not shown), in the usual manner.

As the broadhead 20 strikes and moves forwardly into the target (not shown), the target applies a generally rearward force to the leading tips 84. The force of striking the target urges the blades 28 to pivot in the extending direction (i.e., toward the deployed position). More specifically, the force of striking the target causes the blades 28 to pivot so that the retention band 32 rapidly elongates and breaks. The continued forward movement of the arrow 22 (and the corresponding application of force to the blades 28) after the band 32 breaks causes the blades 28 to move rapidly into the deployed position. With the blades 28 fully deployed and in engagement with the target along the length of the cutting edges 88, additional forward movement of the arrow 22 causes the broadhead 20 to slice the target along the entire lateral head width defined by the blades 28. After the arrow 22 has been retrieved from the target, the blades 28 can again be located in the retracted position and held with another retention band 32 for subsequent use.

Turning to FIGS. 10 and 11, an alternative embedment of the broadhead of the present invention is described. It should be understood that while the blade configuration of the alternative embodiment varies from the blade configuration described with respect to the first exemplary embodiment, the general arrangement and operation of the blade mechanism, such as movement from the retracted to the extended position, is identical and thus a description of that operation is not repeated, it is understood to be the same as that previously described and one skilled in the art will recognize that identical operation. It should be further understood that features of the first and second exemplary embodiments can be combined in accordance with the present invention.

Looking first to FIG. 10, an expandable broadhead 220 is constructed in accordance with a second exemplary embodiment of the present invention. The broadhead 220 is operable to be used as a part of a broadhead arrow 222 by an archer using a bow (not shown). The broadhead arrow 222 is preferably used to hunt turkey, but can be used to hunt various other game, such as deer, elk, etc. The broadhead preferably includes a ferrule 226, blades 228, hinge pin 230, and an endless retention band 232.

In addition to the broadhead 220, the broadhead arrow 222 also preferably includes an elongated shaft 234, fletching 236, threaded insert 238, and a nock 240. The shaft 234 is conventional and presents forward and aft shaft ends 242, 244. Preferably, the shaft 234 is unitary and includes a carbon fiber tube that extends continuously between the shaft ends 242, 244. However, it will be appreciated that the shaft 234 could include one or more of various other materials, such as wood, aluminum, synthetic resin, etc.

Turning to FIG. 11, the ferrule 226 is preferably unitary and includes a forward ferrule tip 246 and an aft shank 248 that presents corresponding forward and aft ferrule ends 250, 252. The aft shank 248 presents a threaded tip 248*a* that is removably threaded into the insert 238. The ferrule 226 extends continuously between the tip 246 and shank 248 to define a longitudinal ferrule axis A. The ferrule 226 preferably presents a maximum ferrule length L that ranges from about forty millimeters (40 mm) to about one hundred fifty millimeters (150 mm) and, more preferably, is about eighty millimeters (80 mm). The ferrule 26 also presents a maximum ferrule diameter F that ranges from about four millimeters (4 mm) to about twenty millimeters (20 mm) and, more preferably, is about eight millimeters (8 mm).

The ferrule 226 presents an outer surface 254 that extends longitudinally between the tip 246 and shank 248. The illustrated ferrule 226 presents a mounting hole 256 positioned between the tip 246 and shank 248. The mounting hole 256 is substantially perpendicular to the longitudinal ferrule axis A and projects through the outer surface 254. The mounting hole 256 receives the hinge pin 230, which pivotally mounts the blades 228 to the ferrule 226.

Adjacent to the mounting hole 256, the outer surface 254 includes outer circumferential grooves 258. In a manner to that previously described with respect to the first exemplary embodiment, the grooves 258 removably receive the retention band 232. It should be understood that this second exemplary embodiment includes internal forward and aft blade stops in a manner similar to that previously described with respect to the first exemplary embodiment.

Blades 228 are each preferably unitary and are operable to be expanded from a retracted position to a deployed position when the broadhead 220 strikes a target (not shown). The blades 228 may be identical to each other or may have different configurations. Each blade 228 is preferably unitary and, other than the cutting edge, presents a substantially constant blade thickness dimension. The blade thickness dimension preferably ranges from about two tenths of a millimeter (0.2 mm) to about three millimeters (3 mm) and, more preferably, is about eight tenths of a millimeter (0.8 mm).

Each blade 228 preferably includes a proximal blade section 274, an intermediate blade section 276, and a distal blade section 278. The proximal and distal blade sections 274, 278 present, respectively, a proximal attachment end 280 and a distal end 282. The distal blade section 278 presents a forward facing edge 284 of the broadhead 220 when the blade 228 is retracted. As seen in FIGS. 10 and 11, in this exemplary embodiment the forward facing edge 284 is positioned rearward of the ferrule tip 246.

The blade sections 274, 276, 278 cooperatively present a cutting edge 288 and an opposite blunt edge 290 that both extend along the length of the blade 228. The cutting edge 288 is preferably configured to slice through various animal tissues, including skin, muscle, cartilage, tendons, ligaments, etc. It will be appreciated that the cutting edge 288 may be capable of slicing and/or at least partly cutting into bone and/or other hard animal tissues. Furthermore, the cutting edge 288 is also preferably configured to slice through various plant tissues and synthetic materials.

The illustrated broadhead 220 preferably includes a pair of blades 228. However, it is within the ambit of the present invention where the broadhead 220 includes more than two blades 228 positioned circumferentially about the ferrule 226. For some aspects of the present invention, the broadhead 220 could include a single blade 228.

The blades 228 are preferably attached to the ferrule 226 with the hinge pin 230. The hinge pin 230 preferably comprises a threaded set screw. However, other suitable fasteners could be used to removably mount the blades 228 to the ferrule 226.

The hinge pin 230 secures the blades 228 to the ferrule 226 at a pivot joint 314 so that the blades 228 can be swung into and out of the retracted position. Similarly, the pivot joint 314 permits the blades 218 to be swung into and out of the deployed position. As will be discussed further, the blades 228 are pivotal in a retracting direction to retract the blades 228 and in an opposite extending direction to deploy the blades 228.

In a manner to that previously described with respect to the first exemplary embodiment, the retention band 232 is operable to hold the blades 228 in a retracted position.

To prepare the broadhead 220 to be propelled as part of the arrow 222, the blades 228 are initially swung into the retracted position. With the blades 228 retracted, the retention band 232 can be expanded and passed over the forward facing tips 284 of the blades 228 and moved into alignment with the grooves 258. Once in alignment (or near alignment) with the nd grooves 258, the band 232 can be released so as to collapse into grasping engagement with the ferrule 226 and blades 228.

As the broadhead 220 strikes and moves forwardly into the target (not shown), the target applies a generally rearward force to the forward facing tips 284. The force of striking the target urges the blades 228 to pivot in the extending direction (i.e., toward the deployed position). More specifically, the force of striking the target causes the blades 228 to pivot so that the blades 228 rapidly elongate and break the retention band 232.

Although the above description presents features of exemplary embodiments of the present invention, other exemplary embodiments may also be created in keeping with the principles of the invention. Such other exemplary embodiments may, for instance, be provided with features drawn from one or more of the embodiments described above. Yet further, such other exemplary embodiments may include features from multiple embodiments described above, particularly where such features are compatible for use together despite having been presented independently as part of separate embodiments in the above description.

The exemplary forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

Having thus described the invention what is claimed as new and desired to be secured by Letters Patent is as follows:

1. An expandable broadhead operable to be mounted on an arrow shaft, said expandable broadhead comprising:

an elongated ferrule including a forward ferrule tip and an aft shank operable to connect the broadhead to the arrow shaft, said ferrule presenting a longitudinal ferrule axis; and a blade presenting an elongated cutting edge that extends along the length of the blade, said blade being shiftably mounted relative to the ferrule to shift into and out of a retracted position where the blade extends alongside the ferrule, said blade presenting a forward facing edge in the retracted position, said blade including a distal blade section that presents the forward facing edge, said cutting edge of the distal blade section extending rearwardly from the forward face at an oblique angle relative to the ferrule axis in the retracted position.

2. The expandable broadhead as claimed in claim 1, said forward facing edge being spaced radially outboard of the ferrule, said cutting edge of the distal blade section projecting from the forward facing edge in a radially inboard direction toward the ferrule.

3. The expandable broadhead as claimed in claim 1, said blade presenting a proximal attachment end and a distal end, said attachment end being attached to the ferrule, with the distal end providing the forward facing edge of the broadhead in the retracted position, said cutting edge forming a scalloped region between the proximal attachment end and the distal end.

4. The expandable broadhead as claimed in claim 1, said blade being pivotally mounted relative to the ferrule at a pivot joint to swing into and out of the retracted position.

5. The expandable broadhead as claimed in claim 1, said forward facing edge being located entirely rearward of the ferrule tip in the retracted position.

6. The expandable broadhead as claimed in claim 5, said blade presenting a proximal attachment end and a distal end, said attachment end being pivotally attached to the ferrule at the pivot joint, with the distal end providing the forward facing edge of the broadhead in the retracted position.

7. The expandable broadhead as claimed in claim 6, said ferrule presenting a longitudinal ferrule axis, said blade being pivotal in an extending direction from the retracted position to a deployed position where the blade projects transversely relative to the ferrule axis, said ferrule including a blade stop that engages the blade in one of the positions to restrict pivotal blade movement.

8. The expandable broadhead as claimed in claim 7, said blade stop engaging the blade in the deployed position to restrict pivotal movement of the blade in the extending direction beyond the deployed position.

9. The expandable broadhead as claimed in claim 8, said blade being located entirely rearward of the ferrule tip in the deployed position.

10. The expandable broadhead as claimed in claim 8, said ferrule presenting a slot that extends longitudinally between the ferrule tip and the shank, said pivot joint defining a blade pivot axis that intersects and is perpendicular to the slot, with the attachment end being at least partly pivotally received in the slot.

11. The expandable broadhead as claimed in claim 10, said ferrule presenting an outer surface that extends longitudinally between the ferule tip and the shank, said slot intersecting the outer surface to form opposite slot openings, with the blade stop being positioned laterally between the slot openings.

12. The expandable broadhead as claimed in claim 11, said blade presenting a shoulder that slides into and out of the slot as the blade swings between the positions, with the shoulder being located within the slot in the deployed position to engage the blade stop.

13. The expandable broadhead as claimed in claim 12, said ferrule including another blade stop that engages the blade in the retracted position to restrict pivotal movement of the blade in a retracting direction beyond the retracted position, where the retracting direction is opposite the extending direction.

14. The expandable broadhead as claimed in claim 13, said ferrule presenting a longitudinal ferrule axis, said blade being shiftable into and out of a deployed position where the blade projects transversely relative to the ferrule axis, with the blade being located entirely rearward of the ferrule tip in the deployed position.

15. The expandable broadhead as claimed in claim 1, said ferrule presenting a slot that extends longitudinally between the ferrule tip and the shank, said blade being at least partly received in the slot.

16. The expandable broadhead as claimed in claim 1, further comprising:

another blade presenting another elongated cutting edge that extends along the length of the another blade, said another blade being shiftably mounted relative to the ferrule to shift into and out of a retracted position where the another blade extends alongside the ferrule, said another blade facing forwardly in the retracted position so that the blade presents another forward facing edge of the broadhead.

17. The expandable broadhead as claimed in claim 16, said blades each including a distal blade section that presents the corresponding forward facing edge of the broadhead, said forward facing edges being spaced radially outboard of the ferrule, said cutting edges of the distal blade sections extending rearwardly from the forward facing edges in the retracted position so as to converge toward one another in a rearward direction.

18. The expandable broadhead as claimed in claim 17, said cutting edges of the distal blade sections cooperatively forming an included angle that ranges from about sixty degrees to about one hundred twenty degrees.

19. The expandable broadhead as claimed in claim 18, said blades being pivotally mounted relative to the ferrule at a pivot joint to swing into and out of the retracted position.

20. The expandable broadhead as claimed in claim 19, said blades each presenting a proximal attachment end and a distal end, said attachment ends being pivotally attached to the ferrule at the pivot joint, with the distal ends providing the forward facing edges of the broadhead in the retracted position.

* * * * *